US009988864B2

(12) United States Patent
Behrens et al.

(10) Patent No.: US 9,988,864 B2
(45) Date of Patent: Jun. 5, 2018

(54) TRANSPORT TRAILER REEL AND INJECTOR SHIFT FOR MAXIMIZING COILED TUBING LOAD DISTRIBUTION

(71) Applicant: PREMIER COIL SOLUTIONS, INC., Waller, TX (US)

(72) Inventors: Randall Dean Behrens, Sealy, TX (US); Jeffrey Deane Meyer, Richmond, TX (US)

(73) Assignee: Premier Coil Solutions, Inc., Waller, TX (US)

( * ) Notice: Subject to any disclaimer, the term of this patent is extended or adjusted under 35 U.S.C. 154(b) by 0 days. days.

(21) Appl. No.: 15/659,897

(22) Filed: Jul. 26, 2017

(65) Prior Publication Data

US 2018/0030793 A1 Feb. 1, 2018

Related U.S. Application Data

(60) Provisional application No. 62/366,854, filed on Jul. 26, 2016.

(51) Int. Cl.

| | |
|---|---|
| ***E21B 19/22*** | (2006.01) |
| ***B66C 1/48*** | (2006.01) |
| ***B66F 9/075*** | (2006.01) |
| *E21B 15/04* | (2006.01) |

(52) U.S. Cl.

CPC ..... *E21B 19/22* (2013.01); *B66C 1/485* (2013.01); *B66F 9/07554* (2013.01); *E21B 15/045* (2013.01)

(58) Field of Classification Search

CPC ..... E21B 19/22

See application file for complete search history.

(56) References Cited

U.S. PATENT DOCUMENTS

| | | | | |
|---|---|---|---|---|
| 4,673,035 | A * | 6/1987 | Gipson | E21B 19/22 166/77.1 |
| 8,820,399 | B2 | 9/2014 | Witte et al. | |
| 2009/0069951 | A1 | 3/2009 | Liljeblad et al. | |
| 2009/0114403 | A1 | 5/2009 | Borst et al. | |
| 2013/0140784 | A1* | 6/2013 | Ehrlich | B60G 17/0528 280/124.159 |
| 2013/0297154 | A1* | 11/2013 | Burchett | B62D 35/001 701/49 |
| 2013/0341001 | A1* | 12/2013 | Kos | E21B 19/22 166/77.2 |

OTHER PUBLICATIONS

International Search Report & Written Opinion (PCT/US2017/043883), dated Oct. 5, 2017.

* cited by examiner

*Primary Examiner* — Robert E Fuller

(74) *Attorney, Agent, or Firm* — Lloyd L. Davis; Hunton Andrews Kurth LLP

(57) ABSTRACT

A coiled tubing transport unit includes a coiled tubing reel unit, a first mechanism for shifting the coiled tubing reel unit lengthwise along the coiled tubing transport unit, an injector head, and a second mechanism for shifting the injector head lengthwise along the coiled tubing transport unit.

16 Claims, 4 Drawing Sheets

TRANSPORT TRAILER REEL AND INJECTOR SHIFT FOR MAXIMIZING COILED TUBING LOAD DISTRIBUTION

CROSS-REFERENCE TO RELATED APPLICATIONS

This application claims priority under 35 U.S.C. § 119(e) to U.S. Provisional Application No. 62/366,854, filed Jul. 26, 2016, which is incorporated herein by reference in its entirety.

FIELD

Embodiments disclosed herein relate to the application of delivery methods of coiled tubing equipment through the use of a trailer to transport permanently mounted or removable coiled tubing equipment. This addresses the weight distribution and adjustment of the equipment to meet weight requirements to compensate for load distribution.

BACKGROUND

Coiled tubing is used for interventions in oil and gas wells and production tubing. Coiled tubing equipment may be mounted on trucks, trailers, or skids. Skid and trailer mounted equipment can be permanently affixed, or mounted in such a manner where it is removable from a trailer with little effort. Coiled tubing equipment that is easily transported and serviceable offers owners the best return on their investment. Ideally, transporting coiled tubing equipment efficiently decreases well service costs and reduces man-hours and jobsite injuries. Due to the depths of wells, the tubing footage needed to complete most well servicing jobs has increased, which in turn, the methods of transportation have been strained. Trailer lengths have been extended to offer more axles to allow more equipment or tubing to be transported to and from jobsites. By its inherent nature, the equipment needed for operations is heavy and requires specially modified trailers designed to transport loads of extreme weight, height, length, and width. In most circumstances the amount of weight that is required for the truck tractor and the trailer to haul is in excess of highway regulations. This presents issues with weight distribution, and load adjustments have to be made to conform to laws relating to weight and distribution of over-axle weight.

The heaviest item on a coiled tubing trailer is a spooled coiled tubing reel. In some cases a spooled reel will exceed 100,000 lbs. of weight, and the ability to shift the weight forwards or rearwards will allow increased flexibility in meeting highway laws. Consequently, the coiled tubing injector is the second heaviest item that is placed on the reel trailer, and the ability to shift the weight forwards or rearwards will allow increased flexibility in meeting highway laws.

Previous solutions to ease the weights of the spooled coiled tubing trailers have been to add more axles in the form of a "Jeep" to the fifth wheel of the trailer. The "Jeep" is connected to the truck tractor fifth wheel and has typically 1-3 axles and has its own fifth wheel in which the trailer sits. This allows improved distribution of weight on the front to middle of the trailer caused by the spooled coiled tubing reel. Another solution was the addition of a "Booster" which attaches by bolting or pinning to the rear of the trailer, and has typically 1-3 axles and helps distribute the weight from the trailer axles to the booster axles in order to offset the over-axle weight that the coiled tubing injector induces onto the trailer axles. Jeeps and boosters present several issues, including lengthening of the complete unit, which makes turning radiuses greater and presents time and personnel issues on having to connect and disconnect these units. Jeeps and boosters must also be disconnected prior to operation of the coiled unit at each job site.

Another previous solution was to have several positions along the length of the trailer for the spooled coiled tubing reel to be either mounted permanently to, or temporarily set into place by brackets or affixed positioning devices mounted along the trailer. This proved to be feasible; however, the time needed along with the addition of a crane to lift the spooled coiled tubing reel, proved that the method is not cost effective. What is needed then is an improved coiled tubing transport trailer for maximizing coiled tubing load distribution.

SUMMARY OF THE INVENTION

In one aspect, embodiments disclosed herein relate to a coiled tubing transport unit comprising a coiled tubing reel unit, a first mechanism for shifting the coiled tubing reel unit lengthwise along the coiled tubing transport unit, an injector head, and a second mechanism for shifting the injector head lengthwise along the coiled tubing transport unit.

In another aspect, embodiments disclosed herein relate to a coiled tubing transport unit comprising a coiled tubing reel unit, a first mechanism for shifting the coiled tubing reel unit lengthwise along the coiled tubing transport unit, and a second mechanism for vertically shifting the coiled tubing reel unit.

BRIEF DESCRIPTION OF THE DRAWINGS

The invention is illustrated in the accompanying drawings wherein,

FIG. 2A illustrates a side view of an embodiment of an injector shift.

DETAILED DESCRIPTION

Embodiments disclosed herein relate to coiled tubing transport trailer having reel and injector shift mechanisms for maximizing coiled tubing load distributions. This invention is directed towards the industry wide issues with safely and efficiently distributing the loads evenly on multiple axles. The reel and injector shift safely distributes a spooled coiled tubing reel and the injector to other positions to allow a more uniform distribution of weight. This allows the carrying of more coiled tubing than previously possible with the same or greater amount of axles.

The reel and injector shift reduces the need for trailer additions such as a "Jeep" or a "Booster" by allowing the weight of a spooled coiled tubing reel to be shifted along the transport trailer length. For example, the coiled tubing reel may be shifted horizontally lengthwise along the trailer length up to at least six inches, or up to at least 12 inches, or up to at least 18 inches, or up to at least 24 inches, or up to at least 30 inches, or greater. The reel is not manually moved and re-positioned as previous methods. The reel is positioned on the trailer in a manner in which there is movement forwards and rearwards by hydraulic, pneumatic, electric, magnetic forces, or any other methods.

Figure 1:
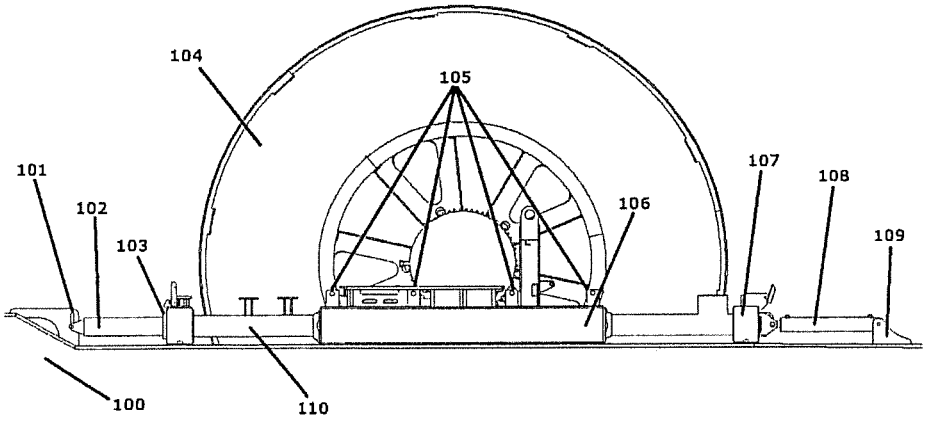
FIG. 1 illustrates a side view of an embodiment of a reel shift.

FIG. 1 illustrates a side view of an embodiment of a reel shift. A transport trailer (100) includes a coiled tubing reel (104) mounted on a skid (106). A hydraulic cylinder (108) is pivotally secured by a pin or other means at a first end to a rigid bracket (109) on the trailer (100) and at a second end (107) to the reel skid (106). A front portion of the reel skid (106) includes a telescoping guide sleeve (110) and arm extension (102) that is retractable into or extendable from the telescoping sleeve (110). The arm extension (102) is pivotally attached at a first end by a pin or other means to a rigid mounting plate (101) on the trailer (100). A seal and retaining plate (103) is disposed at an end of the telescoping sleeve (110). It is understood that while the illustration shows the hydraulic cylinder (108) behind the reel (104) and the telescoping sleeve (110) and extension arm (102) in front, the reverse is also possible.

The spooled coiled tubing reel's (104) movement along the length of the trailer (100) is dictated by the hydraulic cylinder (108). When force is applied to the hydraulic cylinder (108) an arm extends towards the front of the trailer (100). The force applied to the hydraulic cylinder (108) pushes against the reel skid (106) forcing the reel skid forward to the front of the trailer, and effectively shifting thousands of pounds to meet over-axle weight restrictions. As the reel skid (106) moves forward the guide sleeve (110) moves over the extension (102). The extension arm (102) is effectively retracted into and enshrouded by the guide sleeve (110) as the extension arm passes through the seal and retaining plate (103) and into the guide sleeve (110).

During transport, the coiled tubing trailer (100) has the tubing reel (104) positioned in a manner in which the reel fits along the interior of the trailer and extends below the framework of the trailer (100). This causes low ground clearance from the lower frame of the trailer to the ground. This clearance is dependent on the air settings and load amount on the trailer. The ground clearance level can be cumbersome for roadway obstructions such as railroad track grades, speed bumps, or any other roadway issue in which ground clearance isn't appropriate, and may strike the bottom of the reel. The reel can be raised in any manner such as hydraulic, electrically powered, pneumatic or manually operated. In this case the reel is lifted by an actuation of a valve which allows hydraulic fluid to actuate at least one hydraulic cylinder (105) on each side (roadside and curbside) of the reel skid assembly. These hydraulic pistons then extend forcing the skid to rise above the level of the top framework of the trailer (100). This allows extra ground clearance below the framework of the trailer, thus allowing increased ground clearance. The increased ground clearance can be controlled to a certain level or the maximum allowable cylinder travel of the cylinders (105).

The transport trailer is thus configured having both a horizontal shift mechanism and a vertical shift mechanism that may work in unison to balance loads and clear obstacles, or separately as needed by actuation of separate valves. The mounting plate (101) has vertical slots in which the extension arm (102) may travel vertically to adjust for the lifting of the reel skid (106) by the hydraulic cylinders (105), and still retain proper bracing and positioning of the reel skid (106). Transversely the hydraulic cylinder (108) is allowed to pivot vertically along the rigid style mounting bracket (109) during the lifting of the reel skid assembly (106).

Figure 2B:
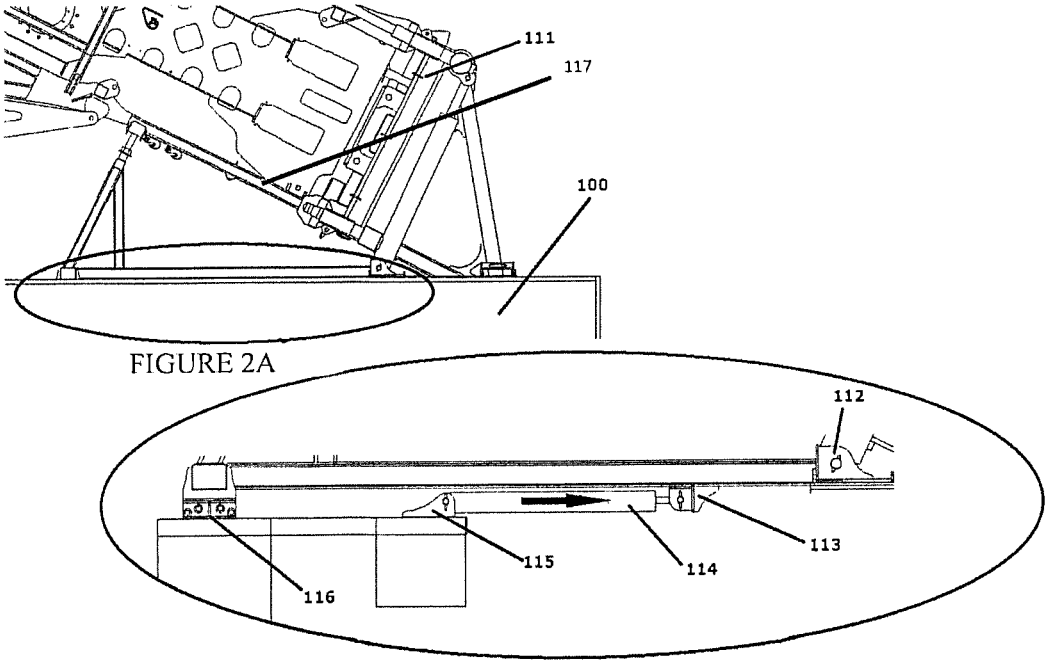
FIG. 2B illustrates an enlarged side view of FIG. 2A.
Figure 3:
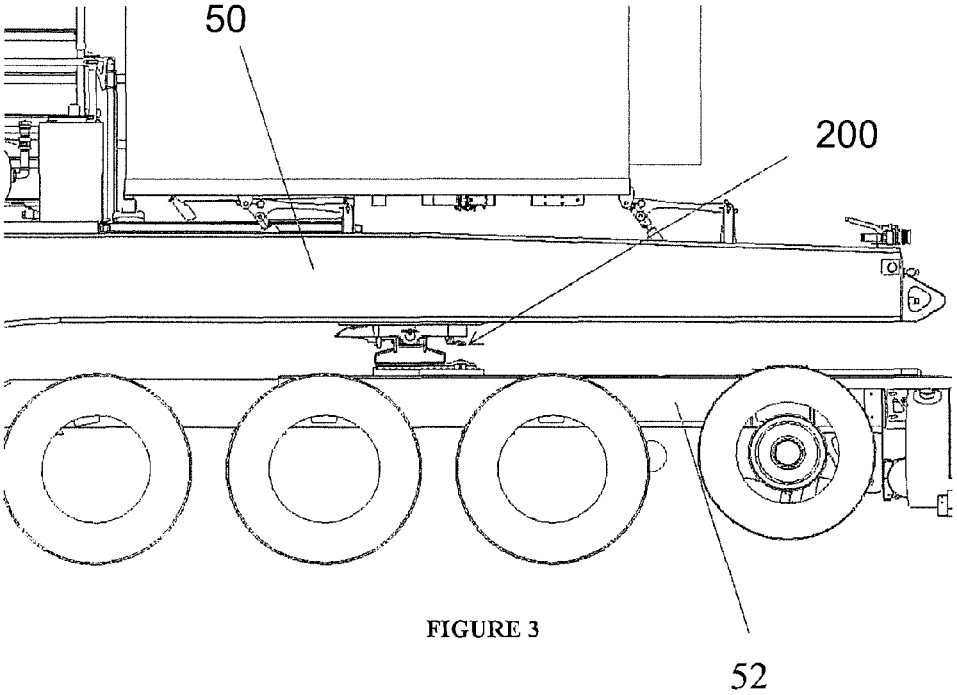
FIG. 3 illustrates a side view of an embodiment of a fifth wheel attachment device.
Figure 4:
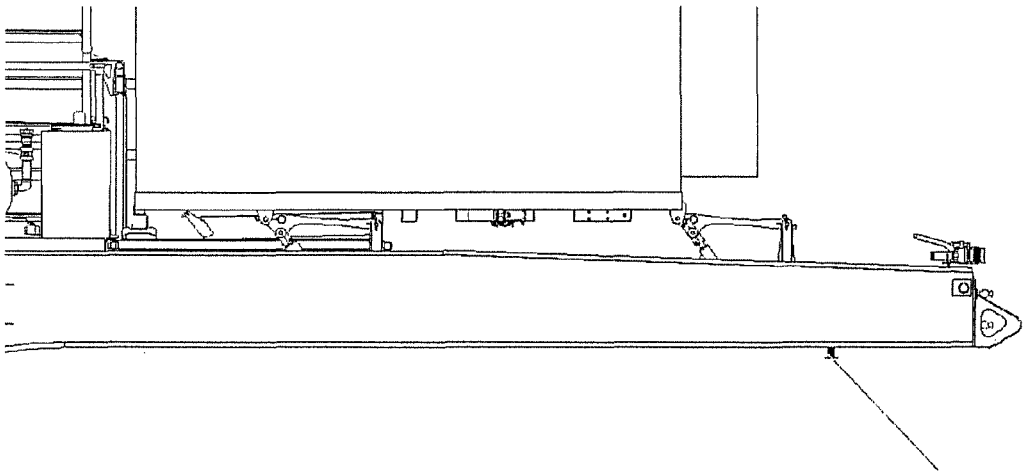
FIG. 4 illustrates a side view of an embodiment of a transport trailer and a kingpin at a first location.
Figure 5:
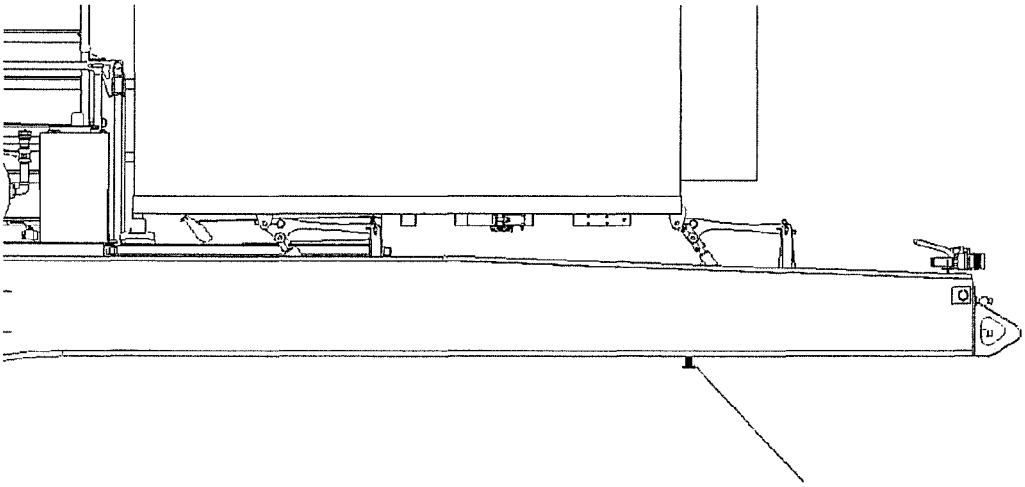
FIG. 5 illustrates a side view of an embodiment oft a transport trailer and a kingpin at a second location.
Figure 6:
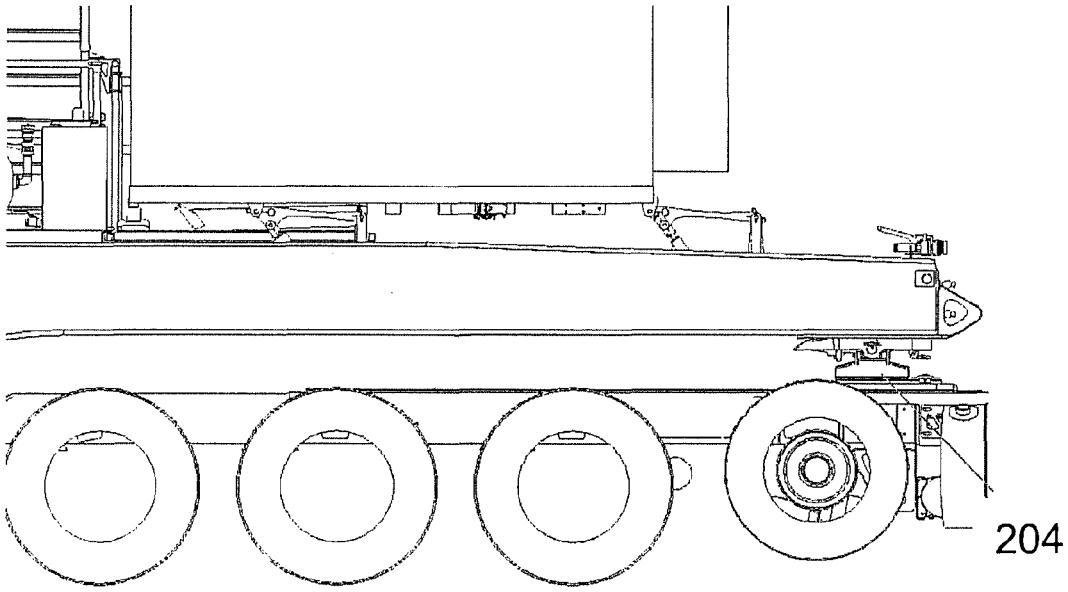
FIG. 6 illustrates a side view of an embodiment of a transport trailer and a fifth wheel at a first location.
Figure 7:
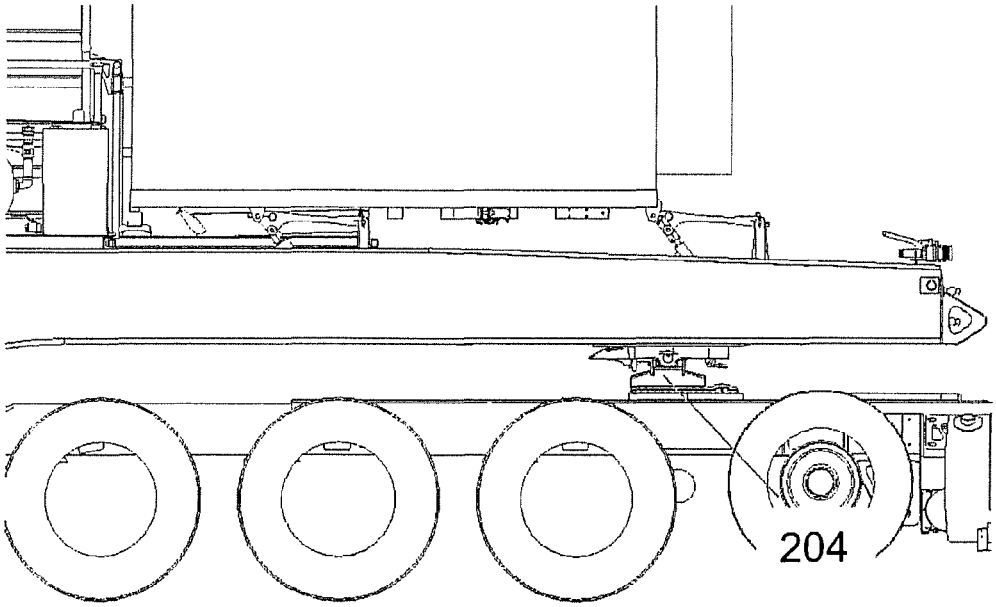
FIG. 7 illustrates a side view of an embodiment of a transport trailer and a fifth wheel at a second location.

FIG. 2 illustrates a side view of an embodiment of an injector shift. The injector shift reduces the need for trailer additions such as a "Booster" by allowing the weight of a coiled tubing injector to be shifted. For example, the coiled tubing reel may be shifted vertically above the trailer up to at least five inches, or up to at least ten inches, or up to at least 15 inches, or up to at least 20 inches, or up to at least 25 inches, or greater. The injector is typically positioned on the rear of a trailer due to the operational need of a relatively straight spooling from the reel to the injector. The injector is usually positioned on the center of the rear of the trailer due to weight distribution, height restrictions and may or may not be recessed below the top of the framework of the trailer. During transport, the injector is positioned in a tilted position with the injector and tubing guide leaning towards the front of the trailer.

Due to the increased pipe size of most wells, the injectors have had to increase in size and mass to represent the increased tubing pull and snubbing of the tubing. This presents a unique problem that could easily cause an over-axle weight condition of one or more trailer axles. Embodiments disclosed herein relate to an injector shifting mechanism in order to distribute the weight of the injector over the last several axles, in order to meet many weight restrictions set forth on the axles that mainly support the injector and tubing guide.

The injector (111) sits on a tilting mechanism that extends below the top of the trailer (100) by the removal of a portion of the rear of a trailer. This allows the injector (111) to take advantage of available space beneath of and or in-between the frame rails. The injector weight can be shifted or moved using hydraulic, electric, pneumatic, magnetic, and manual or any other force in which the weight of an injector can be moved.

In one embodiment, hydraulic pressure is actuated by control valve or other mechanism that releases fluid to extend the piston of a hydraulic cylinder or cylinders (114) that are permanently affixed to frame components affixed to a secure mount (115) of the trailer (100). The piston is attached by a pinned method or other method that a secure mount (113) can be affixed to the injector cradle (117) or framework supporting the injector (111). When the hydraulic cylinder actuates, it forces the complete shifting of all injector (111) and cradle (117) components. The shifting may be isolated to a single or multiple contact points on the cradle (117) which allows mount points (116 and 112) to shift towards the rear of the trailer until actuation is no longer needed or the hydraulic cylinder reaches a stopping point.

The coiled tubing transport trailer may further include a load balancing air suspension system in which air pressures may be varied or manipulated within suspension air bags associated with different axles of the transport trailer. Air suspension is a type of vehicle suspension powered by an electric or engine-driven air pump or compressor. The compressor pumps air into an air bag, i.e., a flexible bellows, usually made from textile-reinforced rubber or other flexible material. Air is pumped into and inflates the air bag and raises the chassis from the axle. Or air is removed from and deflates the air bag and lowers the chassis toward the axle. Air suspensions are used in place of conventional steel springs in passenger cars, and are commonly used in heavy vehicle applications such as buses, trucks, and semi-trailers.

Air pressure within suspension air bags may be manipulated for different reasons, including to meet state highway and roadway axle weight restrictions or limitations, and to enhance the turning capabilities of larger transport trailers. The transport trailer includes multiple axles along its length. Each axle includes a central shaft fixed to wheels on each end of the axle to rotate the wheels. Tires are mounted on each wheel to provide traction between the trailer and the road while providing a flexible cushion that absorbs shock. Each axle further includes at least one suspension air bag associated at each end of the axle. Each suspension air bag may be a flexible bellows made from textile-reinforced rubber or other flexible material. Each suspension air bag is in communication with an air source and is capable of being inflated or deflated to raise or lower the trailer structure or chassis from the axle.

The coiled tubing transport trailer may further include a steering system that, during reverse movement of a multi-axle trailer, automatically straightens the wheels. The steering system may be disposed on any and multiple axles of a multi-axle trailer. One or more wheels may be disposed on both ends of a steering axle extending lengthwise across the trailer. A rigid linkage, also known as a tie rod, is attached or coupled between the wheels on both ends of the steering axle. The tie rod is part of the steering mechanism and provides a mechanical structure rigidly linking the wheels on both ends of the steering axle and turning the wheels together. A load balancing air suspension system and steering system have been described in detail by, for example, U.S. patent application Ser. No. 15/013,155, which is incorporated by reference herein in its entirety.

In other embodiments, two or more trailer axles, or three or more trailer axles, or four or more trailer axles, may be grouped along a length of a trailer to increase the carrying capacity of the coiled tubing transport trailer. The axles groups may be changed or rearranged with the addition of shifting axles or axles that may be manipulated hydraulically, pneumatically, electrically or by another means. For example, a single axle may be removed from a group of axles and either combined with another group of axles, or disposed as a single axle in front of, behind, or in the middle of another axle group. Any number of single axles may be shifted to distribute the over-axle weight on individual axles needed for roadway compliance.

FIGS. 3-7 illustrates a fifth wheel attachment device in accordance with one or more embodiments disclosed herein. Weight that is shifted forward on a transport trailer (50) is placed, in whole or in part, on an attachment device (200) between the transport trailer (50) and a truck tractor (52), also known as a "fifth-wheel." A fifth-wheel coupling (200) provides a link between a trailer and the towing truck, tractor unit, leading trailer, or dolly. The coupling generally includes a "kingpin," (202) which is a steel pin on the front of the trailer (50), and a horseshoe-shaped coupling device called a "fifth wheel" (204) on the rear of the towing vehicle (52). The surface of the trailer (with the kingpin at the center) rotates against the surface of the fixed fifth wheel, which does not rotate. To reduce friction, grease may be applied on to the surface of the fifth wheel.

In certain embodiments, the kingpin (202) may be disposed at different locations lengthwise on a front end of the transport trailer. The placement of kingpin at different locations on the transport trailer configures the load carrying capacity of the transport trailer due to a large amount of weight that is needed to be placed over the axles of the truck tractor, i.e., the towing vehicle, or attached "Jeep" of the truck tractor. The kingpin may be shifted forward or rearward lengthwise on the transport trailer. The kingpin may be moved or manipulated manually, hydraulically, pneumatically, electrically, or by another other means to allow the redistribution of weight, either more on the trailer or more on the truck tractor, or "Jeep", or combination thereof.

In certain embodiments, the fifth wheel (204) may be disposed at different locations lengthwise on the towing vehicle. The fifth wheel may be shifted forward or rearward lengthwise on the towing vehicle. For example, the fifth wheel may be shifted at least 24 inches, or at least 30 inches, or at least 36 inches, or at least 48 inches, or at least 60 inches, or greater. The fifth wheel may be shifted lengthwise alone, or in combination with shifting the kingpin lengthwise along the transport trailer. Further, in certain embodiments, the towing vehicle may include a steering axle in front and one, or two, or more axles in the rear. In other embodiments, the towing vehicle may include two or more steering axles in front. Two or more front steering axles in combination with a shifting fifth wheel on the towing vehicle, and further in combination with a shift kingpin on the transport trailer, may provide greater flexibility to comply with various transportation and roadway laws.

The claimed subject matter is not to be limited in scope by the specific embodiments described herein. Indeed, various modifications of the invention in addition to those described herein will become apparent to those skilled in the art from the foregoing description. Such modifications are intended to fall within the scope of any claims.

What is claimed is:

1. A coiled tubing transport unit comprising:

a coiled tubing reel unit mounted on a skid;

a telescoping guide sleeve on one end of the skid, and a corresponding arm extension attached to the transport unit, wherein the arm extension is retractable into or extendable from the telescoping guide sleeve;

a hydraulic cylinder attached between the skid and the transport unit, wherein the arm extension retracts into or extends from the telescoping guide sleeve when the hydraulic cylinder is actuated to push or pull against and move the skid in a longitudinal direction;

an injector head; and a second mechanism for shifting the injector head lengthwise along the coiled tubing transport unit.

2. The coiled tubing transport unit of claim 1, wherein the second mechanism is hydraulically actuated.

3. The coiled tubing transport unit of claim 1, wherein the second mechanism is selected from the group consisting of pneumatic, electric, and magnetic actuated mechanisms.

4. The coiled tubing transport unit of claim 1, further comprising a third mechanism for vertically shifting the coiled tubing reel unit vertically.

5. The coiled tubing transport unit of claim 4, wherein the third mechanism is hydraulically actuated.

6. The coiled tubing transport unit of claim 1, further comprising a load balancing air suspension system.

7. The coiled tubing transport unit of claim 1, further comprising a kingpin coupling configured to engage a coupling device on a towing vehicle, wherein the kingpin coupling is disposable at different locations lengthwise on the trailer.

8. The coiled tubing transport unit of claim 7, wherein the coupling device is disposable at different locations lengthwise on the towing vehicle.

9. A coiled tubing transport unit comprising:

a coiled tubing reel unit mounted on a skid;

a telescoping guide sleeve on one end of the skid and a corresponding arm extension attached to the transport unit, wherein the arm extension is retractable into or extendable from the telescoping guide sleeve;

a hydraulic cylinder attached between the skid and the transport unit, wherein the arm extension retracts into or extends from the telescoping guide sleeve when the hydraulic cylinder is actuated to push or against and move the skid in a longitudinal direction;

and a second mechanism for vertically shifting the coiled tubing reel unit skid.

10. The coiled tubing transport unit of claim 9, wherein the second mechanism is hydraulically actuated.

11. The coiled tubing transport unit of claim 9, further comprising an injector head and a third mechanism for shifting the injector head lengthwise along the coiled tubing transport unit.

12. The coiled tubing transport unit of claim 11, wherein the third mechanism is hydraulically actuated.

13. The coiled tubing transport unit of claim 9, further comprising a load balancing air suspension system.

14. The coiled tubing transport unit of claim 9, further comprising a kingpin coupling configured to engage a coupling device on a towing vehicle, wherein the kingpin coupling is disposable at different locations lengthwise on the trailer.

15. The coiled tubing transport unit of claim 14, wherein the coupling device is disposable at different locations lengthwise on the towing vehicle.

16. A coiled tubing transport unit comprising:

a coiled tubing reel unit mounted on a skid;

a guide sleeve on one end of the skid, and a corresponding arm extension attached to the transport unit, wherein the arm extension is retractable into or extendable from the guide sleeve; and a hydraulic cylinder attached between the skid and the transport unit, wherein the arm extension retracts into or extends from the guide sleeve when the hydraulic cylinder is actuated to push or pull against and move the skid in a longitudinal direction.

* * * * *